US012196433B2

(12) United States Patent
Nakano et al.

(10) Patent No.: US 12,196,433 B2
(45) Date of Patent: Jan. 14, 2025

(54) HEAT EXCHANGE UNIT AND AIR CONDITIONER

(71) Applicant: DAIKIN INDUSTRIES, LTD., Osaka (JP)

(72) Inventors: Hiroyuki Nakano, Osaka (JP); Shota Ago, Osaka (JP); Atsushi Yamamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/621,298

(22) Filed: Mar. 29, 2024

(65) Prior Publication Data

US 2024/0240804 A1 Jul. 18, 2024

Related U.S. Application Data

(63) Continuation of application No. PCT/JP2022/018454, filed on Apr. 21, 2022.

(30) Foreign Application Priority Data

Sep. 30, 2021 (JP) ..... 2021-161753

(51) Int. Cl.
*F24F 1/0068* (2019.01)
*F24F 1/0067* (2019.01)
*F28F 19/02* (2006.01)

(52) U.S. Cl.
CPC ..... *F24F 1/0068* (2019.02); *F24F 1/0067* (2019.02); *F28F 19/02* (2013.01); *F28F 2245/00* (2013.01)

(58) Field of Classification Search
CPC ..... F24F 1/0067; F24F 1/0068; F28F 19/02; F28F 2245/00
See application file for complete search history.

(56) References Cited

FOREIGN PATENT DOCUMENTS

| | | | | |
|---|---|---|---|---|
| EP | 2423609 A2 | 2/2012 | | |
| EP | 2620736 A2 * | 7/2013 | ..... | F24F 1/0068 |
| JP | 2005-262248 A | 9/2005 | | |
| JP | 2005-308292 A | 11/2005 | | |

(Continued)

OTHER PUBLICATIONS

Written Opinion issued in corresponding International Application No. PCT/JP2022/018454 mailed Jul. 5, 2022 (3 pages).

(Continued)

*Primary Examiner* — Eric S Ruppert
*Assistant Examiner* — Hans R Weiland
(74) *Attorney, Agent, or Firm* — Osha Bergman Watanabe & Burton LLP

(57) ABSTRACT

A connection pipe of a heat exchange unit includes a second refrigerant pipe made of a second metal higher in potential than a first metal of a first refrigerant pipe. The second refrigerant pipe includes a first section that is bent to protrude upward. The first section includes a first curved section disposed on a first refrigerant pipe side relative to an apex of the first section and a second curved section disposed on a side opposite to the first refrigerant pipe side relative to the apex of the first section. A covering member or a coating film is provided in intimate contact with the second refrigerant pipe to cover a first refrigerant pipe side edge of the second refrigerant pipe and the first curved section.

7 Claims, 8 Drawing Sheets

(56) References Cited

FOREIGN PATENT DOCUMENTS

| | | | | | |
|---|---|---|---|---|---|
| JP | 2012-042169 | A | | 3/2012 | |
| JP | 2013-155892 | A | | 8/2013 | |
| JP | 2015140998 | A | * | 8/2015 | ..... F24F 1/0007 |
| JP | 2015180851 | A | * | 10/2015 | |
| JP | 2018115774 | A | * | 7/2018 | |
| WO | 2013/094386 | A1 | | 6/2013 | |
| WO | WO-2013084433 | A1 | * | 6/2013 | ..... C23F 13/08 |

OTHER PUBLICATIONS

International Search Report issued in corresponding International Application No. PCT/JP2022/018454 mailed Jul. 5, 2022 (5 pages).
Decision to Grant a Patent issued in corresponding JP application No. 2021-161753 mailed Jun. 28, 2022 (5 pages).
International Preliminary Report on Patentability issued in corresponding International Application No. PCT/JP2022/018454 mailed Apr. 11, 2024 (5 pages).
Extended European Search Report issued in counterpart European Application No. 22875433.9, mailed Nov. 22, 2024 (6 pages).

* cited by examiner

HEAT EXCHANGE UNIT AND AIR CONDITIONER

CROSS REFERENCE TO RELATED APPLICATIONS

This application is a Continuation of PCT International Patent Application No. PCT/JP2022/018454, filed on Apr. 21, 2022, which claims priority under 35 U.S.C. § 119(a) to Japanese Patent Application No. 2021-161753, filed in Japan on Sep. 30, 2021. The contents of these applications are incorporated herein by reference in their entirety.

BACKGROUND

Technical Field

The present disclosure relates to a heat exchange unit and an air conditioner.

Discussion of the Background

Examples of a known heat exchange unit include an indoor unit constituting a part of an air conditioner (see, for example, JP 2013-155892 A). Such an indoor unit includes a casing and a heat exchanger disposed in the casing. A refrigerant is taken in and out of the heat exchanger through a connection pipe.

The connection pipe includes a bent section formed to protrude upward. The connection pipe further includes a first refrigerant pipe disposed adjacent to the heat exchanger and a second refrigerant pipe disposed remote from the heat exchanger. The first refrigerant pipe is formed of aluminum or an aluminum alloy, while the second refrigerant pipe is formed of copper or a copper alloy.

SUMMARY

In a first aspect, a heat exchange unit of the present disclosure includes:

a heat exchanger; and a connection pipe that is connected to the heat exchanger and through which a refrigerant flows, in which the connection pipe includes:

a first refrigerant pipe having one end connected to the heat exchanger and formed of a first metal; and a second refrigerant pipe formed of a second metal having a smaller ionization tendency than an ionization tendency of the first metal of the first refrigerant pipe, second refrigerant pipe having one end connected to the other end of the first refrigerant pipe, the second refrigerant pipe includes:

a first section that is bent to protrude upward, the first section having an end of the first section remote from the first refrigerant pipe;

a second section that is continuous with the end of the first section and extends along an approximate vertical direction, the first section includes:

a first curved section disposed adjacent to the first refrigerant pipe relative to an apex of the first section; and a second curved section disposed remote from the first refrigerant pipe relative to the apex of the first section, and a covering member or a coating film is provided in intimate contact with (adheres to) the second refrigerant pipe to cover the one end of the second refrigerant pipe adjacent to the first refrigerant pipe and the first curved section.

In a second aspect, a heat exchange unit includes:

a heat exchanger; and a connection pipe, connected to the heat exchanger, through which a refrigerant flows, wherein the connection pipe includes a first refrigerant pipe made of a first metal and a second refrigerant pipe made of a second metal higher in potential than the first metal, one end of the first refrigerant pipe is connected to the heat exchanger, and the other end of the first refrigerant pipe is connected to one end of the second refrigerant pipe, the second refrigerant pipe includes:

a bent section protruding upward; and a vertical straight section that extends along an approximate vertical direction and that is continuous with and connected to an end of the bent section on a side opposite to a first refrigerant pipe side, the bent section includes:

a first curved section disposed on the first refrigerant pipe side relative to an apex of the bent section; and a second curved section disposed on the side opposite to the first refrigerant pipe side relative to the apex of the bent section, and a covering member or a coating film adheres to the second refrigerant pipe and covers the one end of the second refrigerant pipe that is on the first refrigerant pipe side and the first curved section.

In the second aspect, the covering member or the coating film may cover the other end of the first refrigerant pipe that is on a second refrigerant pipe side.

The approximate vertical direction means a vertical direction or a direction inclined at an angle of, for example, 20 degrees or less relative to the vertical direction.

DESCRIPTION OF THE EMBODIMENTS

Figure 1:
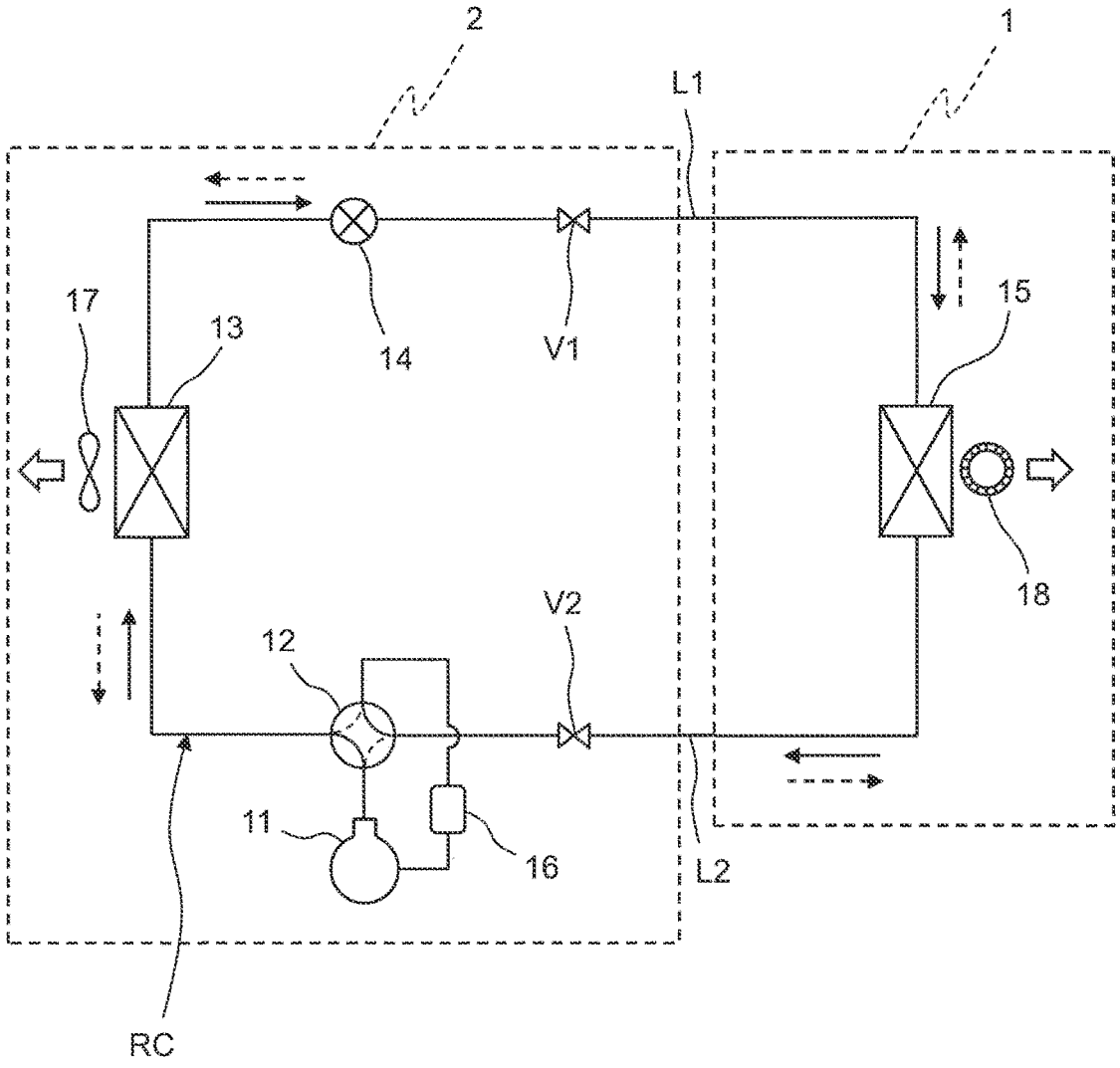
FIG. 1 is a refrigerant circuit diagram of an air conditioner of a first example of the present disclosure.

A heat exchange unit and an air conditioner of the present disclosure will be described in detail below with reference to embodiments illustrated in the drawings. Note that the same parts in the drawings are denoted by the same reference numerals to avoid the description from being redundant. Upper, lower, left, and right in the description correspond to upper, lower, left, and right in a state where an indoor unit is installed in a room.

First Example

FIG. 1 is a diagram illustrating a refrigerant circuit RC provided in an air conditioner of a first example of the present disclosure. This air conditioner is of a type in which an outdoor unit 2 is paired one-to-one with an indoor unit 1. The indoor unit 1 is an example of the heat exchange unit.

The air conditioner includes the indoor unit 1 and the outdoor unit 2 connected to the indoor unit 1 via the refrigerant circuit RC.

The refrigerant circuit RC includes a compressor 11, a four-way switching valve 12, an outdoor heat exchanger 13, an electric expansion valve 14, an indoor heat exchanger 15 as an example of a heat exchanger, and an accumulator 16. As the compressor 11 is driven, a refrigerant (for example, an HFC refrigerant such as R410A or R32) circulates in the refrigerant circuit RC.

More specifically, the four-way switching valve 12 has one end connected to a discharge side of the compressor 11. The four-way switching valve 12 has the other end connected to one end of the outdoor heat exchanger 13. The outdoor heat exchanger 13 has the other end connected to one end of the electric expansion valve 14. The electric expansion valve 14 has the other end connected to one end of the indoor heat exchanger 15 via a shutoff valve V1 and a connection pipe L1. The indoor heat exchanger 15 has the other end connected to one end of the accumulator 16 via a connection pipe L2, a shutoff valve V2, and the four-way switching valve 12. The accumulator 16 has the other end connected to an intake-side portion of the compressor 11.

The indoor unit 1 is equipped with the indoor heat exchanger 15 and an indoor fan 18. The indoor fan 18 is, for example, a cross-flow fan, and takes in indoor air through the indoor heat exchanger 15.

The outdoor unit 2 is equipped with the compressor 11, the four-way switching valve 12, the outdoor heat exchanger 13, the electric expansion valve 14, the accumulator 16, and an outdoor fan 17.

The air conditioner switches the four-way switching valve 12 to a switching position indicated by a solid line to activate the compressor 11 for cooling operation and dehumidifying operation, and switches the four-way switching valve 12 to a switching position indicated by a dotted line to activate the compressor 11 for heating operation. A direction of a solid arrow in FIG. 1 indicates a direction in which the refrigerant flows during the cooling operation and the dehumidifying operation. A direction indicated by a dotted arrow in FIG. 1 indicates a direction in which the refrigerant flows during the heating operation.

Figure 2:
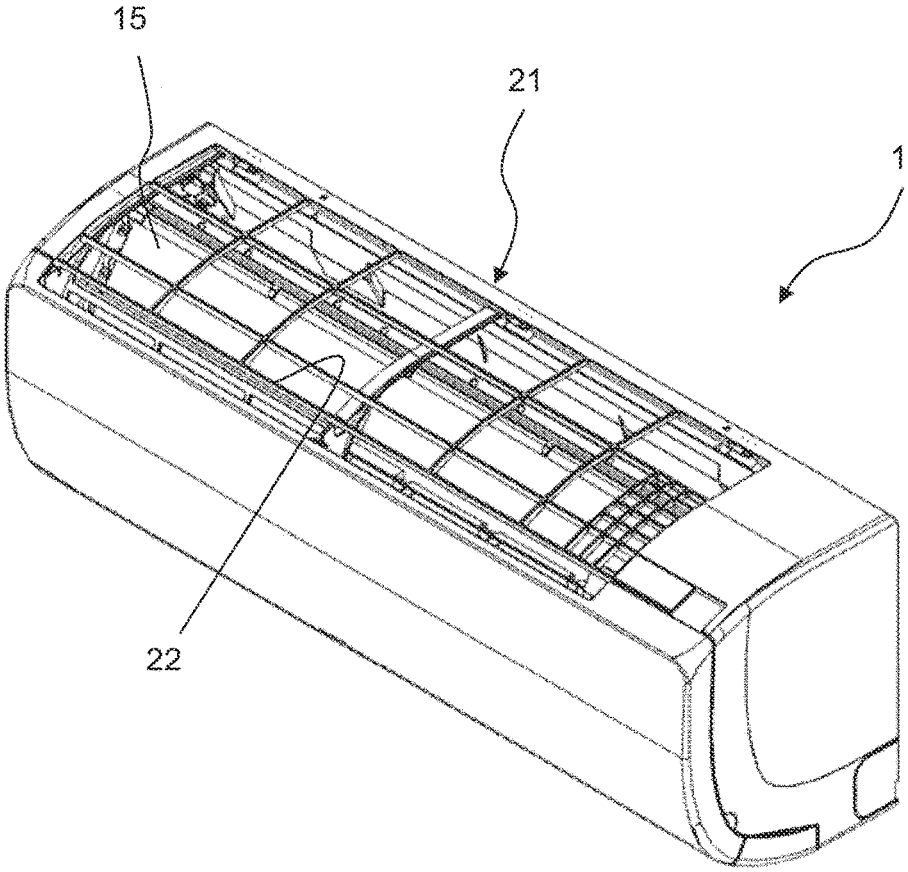
FIG. 2 is a perspective view of an indoor unit of the air conditioner of the first example.
Figure 3:
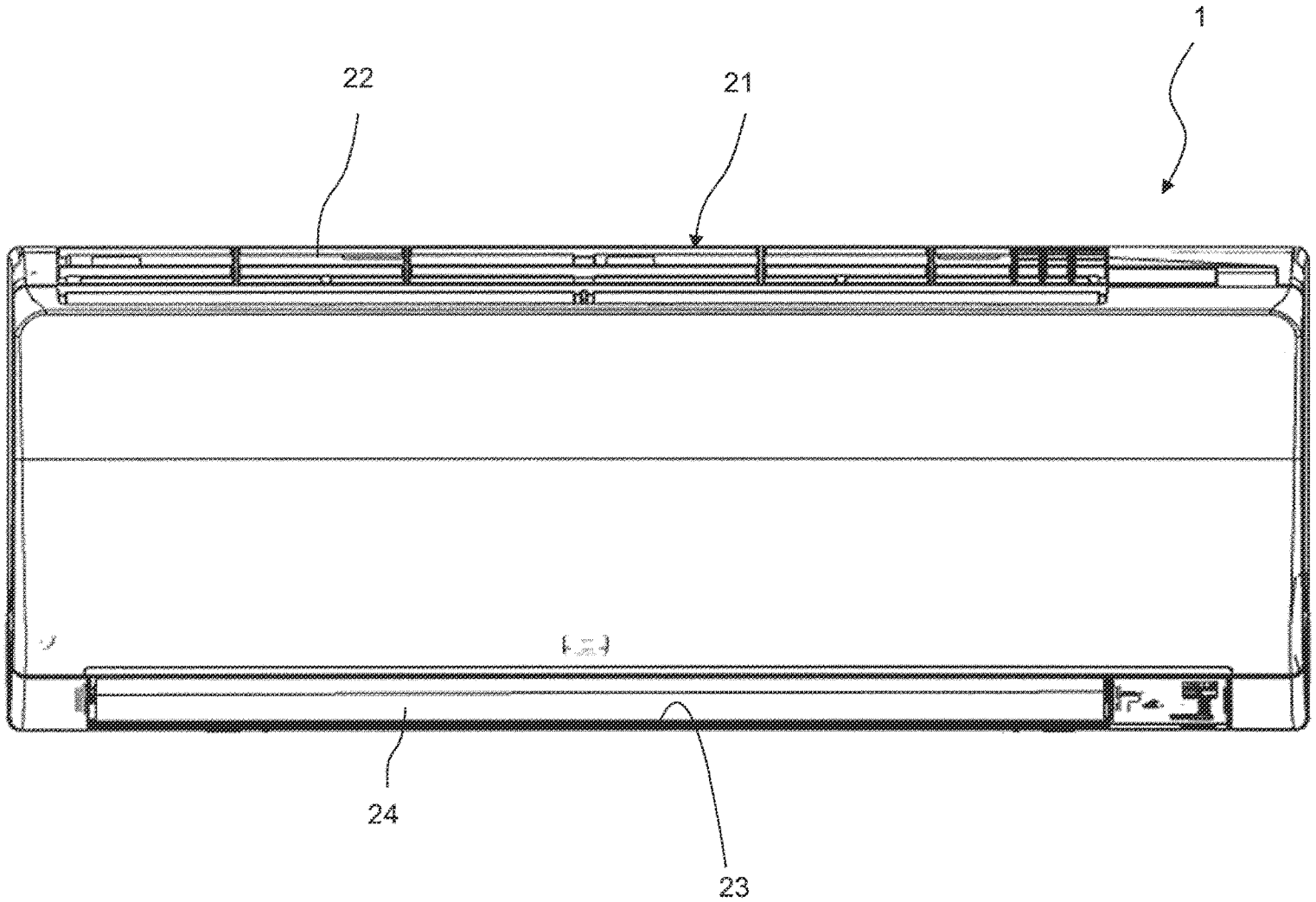
FIG. 3 is a front view of the indoor unit of the air conditioner of the first example.

FIG. 2 is a perspective view of the indoor unit 1 as viewed obliquely from above. FIG. 3 is a front view of the indoor unit 1.

As illustrated in FIGS. 2 and 3, the indoor unit 1 includes a casing 21, and the indoor heat exchanger 15, the indoor fan 18, and the like are accommodated in the casing 21.

An upper portion of the casing 21 is provided with an intake port 22 through which indoor air is taken in. When the indoor fan 18 is driven, indoor air enters the casing 21 through the intake port 22 and flows toward the indoor fan 18. At this time, in order to prevent dust and the like from entering the casing 21 together with indoor air, a filter (not illustrated) is attached to the intake port 22.

A lower portion of the casing 21 is provided with a blow-out port 23 through which air from the indoor fan 18 (indoor air subjected to heat exchange with the indoor heat exchanger 15) blows out. A horizontal flap 24 is rotatably attached to a peripheral edge portion of the blow-out port 23.

When the cooling operation or the like is started, the horizontal flap 24 changes its position from a stop position to close the blow-out port 23 to an operation position to open the blow-out port 23 to adjust a vertical airflow direction of air blown out from the blow-out port 23.

Figure 4:
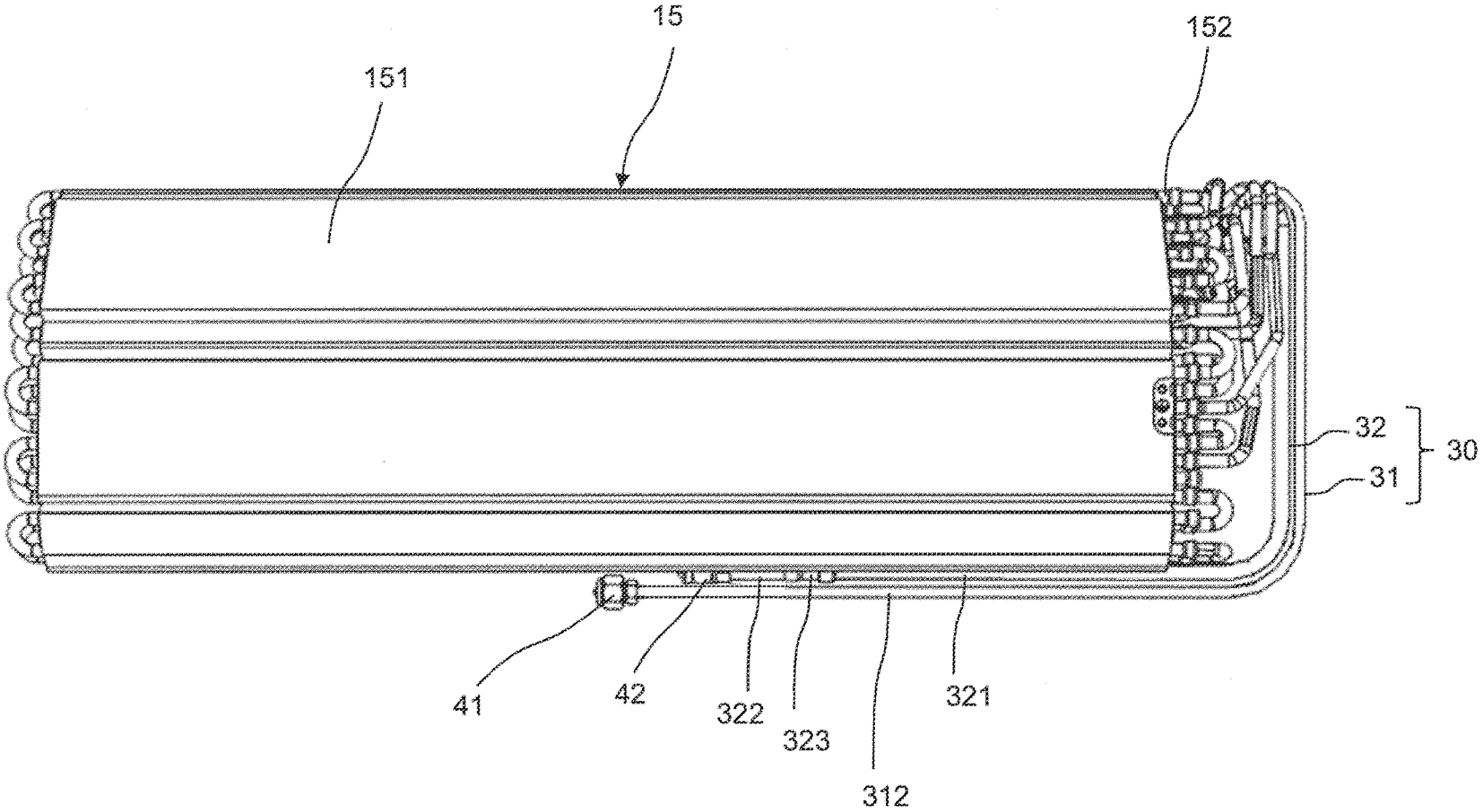
FIG. 4 is a front view of an indoor heat exchanger of the first example and a peripheral portion of the indoor heat exchanger.

FIG. 4 is a front view of the indoor heat exchanger 15 and a peripheral portion of the indoor heat exchanger 15.

The indoor heat exchanger 15 includes a heat exchange portion 151 and a plurality of heat transfer tubes 152 extending through the heat exchange portion 151 in a left-right direction. The heat exchange portion 151 and the heat transfer tubes 152 are each formed of aluminum or an aluminum alloy.

The indoor unit 1 further includes a connection pipe 30 that is fluidly connected to the heat transfer tubes 152 of the indoor heat exchanger 15 and through which the refrigerant flows.

The connection pipe 30 includes a liquid-refrigerant connection pipe 31 constituting a part of the connection pipe L1 and a gas-refrigerant connection pipe 32 constituting a part of the connection pipe L2. The liquid-refrigerant connection pipe 31 guides a liquid refrigerant from the electric expansion valve 14 to the indoor heat exchanger 15 during the cooling operation and the dehumidifying operation. On the other hand, the gas-refrigerant connection pipe 32 guides a gas refrigerant from the indoor heat exchanger 15 to the compressor 11 during the cooling operation and the dehumidifying operation. The liquid-refrigerant connection pipe 31 and the gas-refrigerant connection pipe 32 are each an example of the connection pipe.

<Configuration of Liquid-Refrigerant Connection Pipe 31>

The liquid-refrigerant connection pipe 31 has includes a first liquid-refrigerant pipe 311 (illustrated in FIG. 5) formed of aluminum or an aluminum alloy, and a second liquid-refrigerant pipe 312 formed of copper or a copper alloy. The first liquid-refrigerant pipe 311 has one end fluidly connected to the heat transfer tubes 152 of the indoor heat exchanger 15. The first liquid-refrigerant pipe 311 is an example of a first refrigerant pipe. The aluminum and the aluminum alloy are each an example of a first metal. The second liquid-refrigerant pipe 312 is an example of a second refrigerant pipe. The copper and the copper alloy are each an example of a second metal.

The second liquid-refrigerant pipe 312 has one end fluidly connected to the other end of the first liquid-refrigerant pipe 311 through a third liquid-refrigerant pipe (a stainless steel refrigerant pipe) 313 (illustrated in FIG. 5) formed of stainless steel. On the other hand, the second liquid-refrigerant pipe 312 has the other end fixed to a liquid-refrigerant flare union 41 by brazing.

The third liquid-refrigerant pipe 313 has a lower end fixed to an end of the second liquid-refrigerant pipe 312 adjacent to the third liquid-refrigerant pipe 313 by brazing, i.e., fixed to the one end of the second liquid-refrigerant pipe 312 by brazing. On the other hand, the third liquid-refrigerant pipe 313 has an upper end fixed to an end of the first liquid-refrigerant pipe 311 adjacent to the third liquid-refrigerant pipe 313 by brazing, i.e., fixed to the other end of the first liquid-refrigerant pipe 311 by brazing. The upper end of the third liquid-refrigerant pipe 313 corresponds to an end of the third liquid-refrigerant pipe 313 adjacent to the second liquid-refrigerant pipe 312, i.e., a second-liquid-refrigerant-pipe 312-side end of the third liquid-refrigerant pipe 313. The lower end of the third liquid-refrigerant pipe 313 corresponds to an end of the third liquid-refrigerant pipe 313 adjacent to the first liquid-refrigerant pipe 311, i.e., a first-liquid-refrigerant-pipe 311-side end of the third liquid-refrigerant pipe 313.

<Configuration of Gas-Refrigerant Connection Pipe 32>

The gas-refrigerant connection pipe 32 is similar in configuration to the liquid-refrigerant connection pipe 31, and includes a first gas-refrigerant pipe 321 formed of aluminum or an aluminum alloy, and a second gas-refrigerant pipe 322 formed of copper or a copper alloy.

The first gas-refrigerant pipe 321 has one end fluidly connected to the heat transfer tubes 152 of the indoor heat exchanger 15.

The second gas-refrigerant pipe 322 has one end fluidly connected to the other end of the first gas-refrigerant pipe 321 through a third gas-refrigerant pipe (a stainless steel refrigerant pipe) 323 formed of stainless steel. On the other hand, the second gas-refrigerant pipe 322 has the other end fixed to a gas-refrigerant flare union 42 by brazing.

Figure 5:
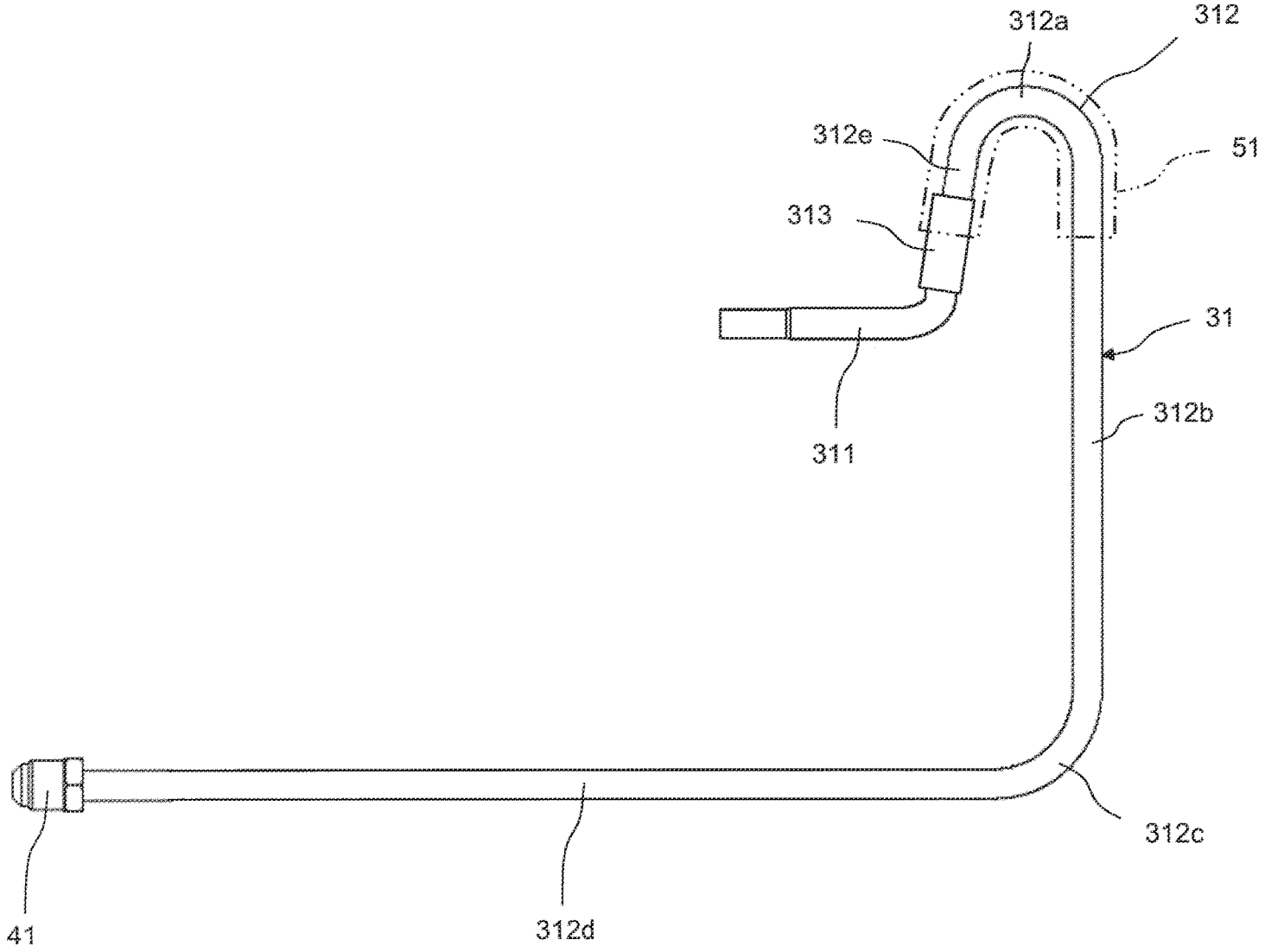
FIG. 5 is a front view of a liquid-refrigerant connection pipe of the first example.
Figure 6:
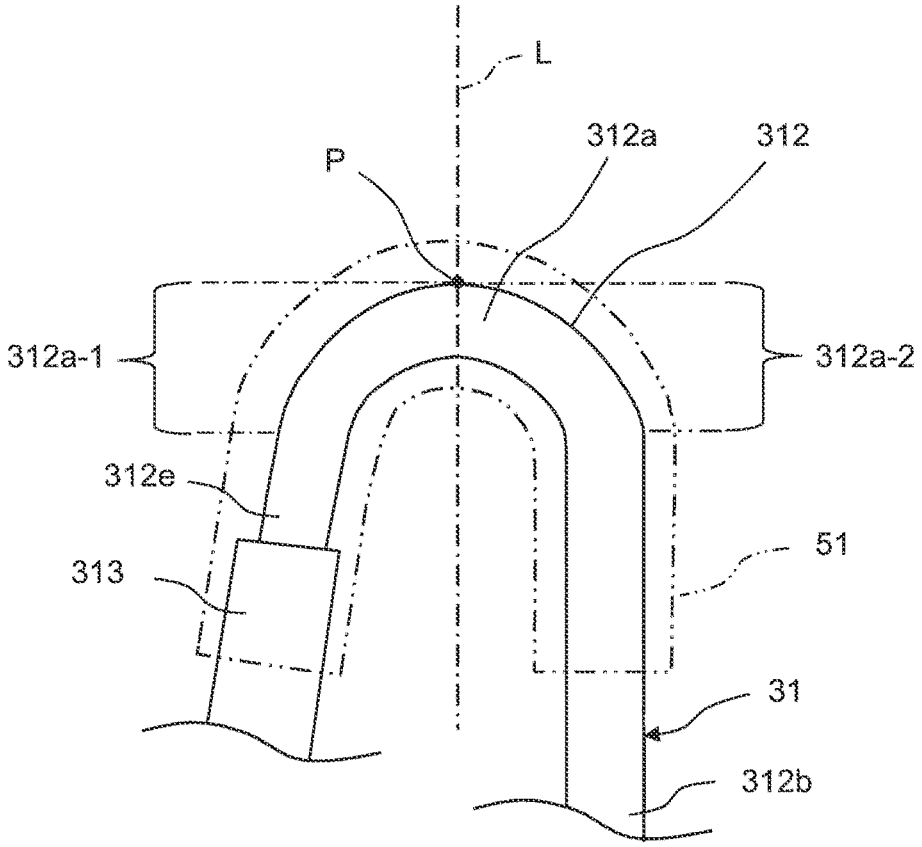
FIG. 6 is an enlarged view of a main portion of a second liquid-refrigerant pipe of the first example.

FIG. 5 is a front view of the liquid-refrigerant connection pipe 31 and a peripheral portion of the liquid-refrigerant connection pipe 31. FIG. 6 is an enlarged view of a main portion of the second liquid-refrigerant pipe 312 of the liquid-refrigerant connection pipe 31.

As illustrated in FIGS. 5 and 6, the second liquid-refrigerant pipe 312 of the liquid-refrigerant connection pipe 31 includes a first section (a bent section) 312*a* and a second section (a vertical straight section) 312*b* disposed below and integrally formed with the first section 312*a*, i.e., seamlessly formed with the first section 312*a*.

The second liquid-refrigerant pipe 312 further includes a third section (an additional bent section) 312*c* and a fourth section (a horizontal straight section) 312*d* provided adjacent to the liquid-refrigerant flare union 41 relative to the second section 312*b*.

The second liquid-refrigerant pipe 312 further includes a fifth section (a bent connecting section) 312*e* provided adjacent to the third liquid-refrigerant pipe 313 relative to the first section 312*a*.

The second liquid-refrigerant pipe 312 has an outer peripheral surface extending from a lower end of the fifth section 312*e* to an upper end of the second section 312*b*, the outer peripheral surface entirely being covered with a waterproof tube 51. The waterproof tube 51 is an example of a covering member. The lower end of the fifth section 312*e* corresponds to an end of the fifth section 312*e* adjacent to the first liquid-refrigerant pipe 311, i.e., the one end of the second liquid-refrigerant pipe 312. The upper end of the second section 312*b* corresponds to an end of the second section 312*b* adjacent to the first liquid-refrigerant pipe 311, i.e., a first-liquid-refrigerant-pipe 311-side end of the second section 312*b*.

<Configuration of First Section 312*a*>

The first section 312*a* forms a section of the second liquid-refrigerant pipe 312 that is bent to protrude upward. That is, the second liquid-refrigerant pipe 312 is formed so as to be folded back at first section 312*a*. In other words, the first section 312*a* constitutes a bent pipe portion so as to extend upward from the upper end of the second section 312*b*, make a U-turn, and then extends downward.

More specifically, the first section 312*a* includes a first curved section 312*a*-1 and a second curved section 312*a*-2 provided on a right side of the first curved section 312*a*-1, i.e., on a side opposite to a first-liquid-refrigerant-pipe 311-side relative to the first curved section 312*a*-1. At this time, a vertical line L passing through an apex P of the first section 312*a* corresponds to a boundary line between the first curved section 312*a*-1 and the second curved section 312*a*-2.

The first curved section 312*a*-1 is disposed adjacent to the first liquid-refrigerant pipe 311 relative to the apex P of the first section 312*a*. In other words, the first curved section 312*a*-1 is disposed on the first-liquid-refrigerant-pipe 311-side relative to the apex P of the first section 312*a*. The first curved section 312*a*-1 can be said to be a portion of the first section 312*a*, the portion being adjacent to the first liquid-refrigerant pipe 311 relative to the vertical line L. Here, the portion adjacent to the first liquid-refrigerant pipe 311 corresponds to an upstream portion in a direction of the flow of the refrigerant when the refrigerant flows from the first liquid-refrigerant pipe 311 to the second liquid-refrigerant pipe 312, and corresponds to a downstream portion in a direction of the flow of the refrigerant when the refrigerant flows from the second liquid-refrigerant pipe 312 to the first liquid-refrigerant pipe 311.

The second curved section 312*a*-2 is disposed remote from the first liquid-refrigerant pipe 311 relative to the apex P of the first section 312*a*. In other words, the second curved section 312*a*-2 is disposed on the side opposite to the first-liquid-refrigerant-pipe 311-side relative to the apex P of the first section 312*a*. The second curved section 312*a*-2 can be said to be a portion of the first section 312*a*, the portion being adjacent to the liquid-refrigerant flare union 41 (remote from the first liquid-refrigerant pipe 311) relative to the vertical line L. Here, the portion remote from the first liquid-refrigerant pipe 311 corresponds to a downstream portion in a direction of the flow of the refrigerant when the refrigerant flows from the first liquid-refrigerant pipe 311 to the second liquid-refrigerant pipe 312, and corresponds to an upstream portion in a direction of the flow of the refrigerant when the refrigerant flows from the second liquid-refrigerant pipe 312 to the first liquid-refrigerant pipe 311.

<Configuration of Second Section 312*b*>

The second section 312*b* is formed integrally with the first section 312*a*, i.e., seamlessly with the first section 312*a* and is continuous with a lower end of the second curved section 312*a*-2 of the first section 312*a*. The second section constitutes a straight pipe portion extending along an approximate vertical direction. The lower end of the second curved section 312*a*-2 corresponds to an end of the first section 312*a*, the end being remote from the first liquid-refrigerant pipe 311. The approximate vertical direction refers to a vertical direction or refers to a direction inclined at an angle of, for example, 20 degrees or less relative to the vertical direction.

<Configuration of Third Section 312*c*>

The third section 312*c* is formed integrally with the second section 312*b*, i.e., seamlessly with the second section 312*b* and is continuous with a lower end of the second section 312*b*. The third section 312*c* constitutes a bent pipe portion that extends from the lower end of the second section 312*b* and then extends toward the liquid-refrigerant flare union 41. The lower end of the second section 312*b* corresponds to an end of the second section 312*b* remote from the first liquid-refrigerant pipe 311 (adjacent to the liquid-refrigerant flare union 41).

<Configuration of Fourth Section 312*d*>

The fourth section 312*d* is formed integrally with the third section 312*c* and is continuous with a left end of the third section 312*c*. The fourth section 312*d* constitutes a straight pipe portion extending along an approximate horizontal direction. Here, the left end of the third section 312*c* corresponds to an end of the second liquid-refrigerant pipe 312, the end being remote from the first liquid-refrigerant pipe 311 (adjacent to the liquid-refrigerant flare union 41). The approximate horizontal direction refers to a horizontal direction or a direction inclined at an angle of, for example, 20 degrees or less relative to the horizontal direction.

<Configuration of Fifth Section 312*e*>

The fifth section 312*e* is formed integrally with the first section 312*a*, i.e., seamlessly with the first section 312*a* and is continuous with a lower end of the first curved section 312*a*-1 of the first section 312*a*. The fifth section 312*e* constitutes a straight pipe portion extending along a direction inclined relative to the vertical direction. The lower end of the fifth section 312*e* is fixed to the upper end of the third liquid-refrigerant pipe 313 by brazing. The lower end of the first curved section 312*a*-1 corresponds to an end of the first curved section 312*a*-1 adjacent to the first liquid-refrigerant pipe 311. The lower end of the fifth section 312*e* corresponds to an end of the fifth section 312*e*, the end being adjacent to the first liquid-refrigerant pipe 311 and further corresponds to an end of the second liquid-refrigerant pipe 312, the end being adjacent to the first liquid-refrigerant pipe 311.

<Configuration of Waterproof Tube 51>

The waterproof tube 51 is formed of a tube made of a waterproof material (for example, vinyl chloride, silicone rubber, fluorine-based polymer, or the like) and shrunk by heating. Accordingly, the waterproof tube 51 is in intimate contact with an outer peripheral surface of the second liquid-refrigerant pipe 312.

The waterproof tube 51 is in intimate contact with not only an outer peripheral surface of the first section 312*a* and an outer peripheral surface of the upper end of the second section 312*b* but also an outer peripheral surface of the upper end of the third liquid-refrigerant pipe 313 to cover the entire circumference of the upper end.

In the air conditioner configured as described above, the outer peripheral surface of the first section 312*a* of the second liquid-refrigerant pipe 312 is entirely covered with the waterproof tube 51. This makes it possible to prevent, for example, dew condensation water from flowing from the first section 312*a* of the second liquid-refrigerant pipe 312 toward the first liquid-refrigerant pipe 311. In short, the waterproof tube 51 can reduce the possibility that dew condensation water adheres to the first liquid-refrigerant pipe 311. It is therefore possible to prevent the first liquid-refrigerant pipe 311 from suffering electrolytic corrosion.

Since the waterproof tube 51 is in intimate contact with the outer peripheral surface of the first section 312*a* of the second liquid-refrigerant pipe 312, it is possible to reduce the possibility that liquid such as dew condensation water enters a space between the waterproof tube 51 and the first section 312*a* of the second liquid-refrigerant pipe 312. It is therefore possible to prevent liquid containing copper ions from being generated in the first section 312*a* of the second liquid-refrigerant pipe 312.

Since the waterproof tube 51 further covers the upper end of the third liquid-refrigerant pipe 313, a lower end surface of the first section 312*a* of the second liquid-refrigerant pipe 312, i.e., a boundary surface between the second liquid-refrigerant pipe 312 and the third liquid-refrigerant pipe 313 is not exposed. It is therefore possible to prevent liquid containing copper ions from being generated in the first section 312*a* of the second liquid-refrigerant pipe 312. As a result, it is also possible to reduce the possibility that the first liquid-refrigerant pipe 311 suffers electrolytic corrosion.

The waterproof tube 51 further covers the second curved section 312*a*-2 together with the first curved section 312*a*-1. This makes it possible to prevent liquid containing copper ions from being generated in the second curved section 312*a*-2. It is therefore also possible to reduce the possibility that the first liquid-refrigerant pipe 311 suffers electrolytic corrosion.

In the air conditioner of the first example, one indoor unit 1 may be connected to one outdoor unit 2, or alternatively, a plurality of indoor units 1 may be connected. In other words, the above-described air conditioner is of a pair-type, or alternatively, the air conditioner may be of a multi-type.

The indoor unit 1 is an example of the heat exchange unit in the first example, or alternatively, the outdoor unit 2 may be an example of the heat exchange unit. In other words, for example, the connection pipe fluidly connected to the outdoor heat exchanger 13 may be configured as the first liquid-refrigerant pipe 311 and the second liquid-refrigerant pipe 312. The connection pipe corresponds to a refrigerant pipe between the four-way switching valve 12 and the outdoor heat exchanger 13 or a refrigerant pipe between the outdoor heat exchanger 13 and the electric expansion valve 14.

The first liquid-refrigerant pipe 311 may be formed of aluminum or an aluminum alloy in the first example, or alternatively, may be formed of metal other than aluminum or an aluminum alloy. Also in this case, the metal of which the first liquid-refrigerant pipe 311 is formed is selected so as to be lower in potential than the metal of which the second liquid-refrigerant pipe 312 is formed.

The second liquid-refrigerant pipe 312 may be formed of copper or a copper alloy in the first example, or alternatively, may be formed of metal other than copper or a copper alloy. Also in this case, the metal of which the second liquid-refrigerant pipe 312 is formed is selected so as to be higher in potential than the metal of which the first liquid-refrigerant pipe 311 is formed.

The fifth section 312*e* of the second liquid-refrigerant pipe 312 may extend in a direction inclined relative to the vertical direction in the first example, or alternatively, may extend in the vertical direction.

The second liquid-refrigerant pipe 312 may include the fifth section 312*e* in the first example, or alternatively, need not include the fifth section 312*e*.

The first gas-refrigerant pipe 321 may be formed of aluminum or an aluminum alloy in the first example, or alternatively, may be formed of metal other than aluminum or an aluminum alloy. Also in this case, the metal of which the first gas-refrigerant pipe 321 is formed is selected so as to be lower in potential than the metal of which the second gas-refrigerant pipe 322 is formed.

The second gas-refrigerant pipe 322 may be formed of copper or a copper alloy in the first example, or alternatively, may be formed of metal other than copper or a copper alloy. Also in this case, the metal of which the second gas-refrigerant pipe 322 is formed is selected so as to be higher in potential than the metal of which the first gas-refrigerant pipe 321 is formed.

The position where the second gas-refrigerant pipe 322 has one end connected to the other end of the first gas-refrigerant pipe 321 through the third gas-refrigerant pipe 323 and the position where the second liquid-refrigerant pipe 312 has one end connected to the other end of the first liquid-refrigerant pipe 311 through the third liquid-refrigerant pipe 313 may be set different from each other in the first example, or alternatively, may be set identical to each other. In other words, for example, the first gas-refrigerant pipe 321 and the second gas-refrigerant pipe 322 may be similar in shape to the first liquid-refrigerant pipe 311 and the second liquid-refrigerant pipe 312. In this case, for example, the end of the second gas-refrigerant pipe adjacent to the first gas-refrigerant pipe and the first curved section of the second gas-refrigerant pipe may be covered with a covering member or a coating film that prevents adhesion of liquid.

No flow divider may be interposed between the heat transfer tubes 152 of the indoor heat exchanger 15 and one end of the first liquid-refrigerant pipe 311 in the first example, or alternatively, a flow divider may be interposed. For example, the flow divider may divide one refrigerant flow into two refrigerant flows, or may divide one refrigerant flow into three or more refrigerant flows.

The third liquid-refrigerant pipe 313 may be interposed between the other end of the first liquid-refrigerant pipe 311 and one end of the second liquid-refrigerant pipe 312 in the first example, or alternatively, the third liquid-refrigerant pipe 313 need not be interposed. In other words, for example, the second liquid-refrigerant pipe 312 may have one end directly connected to the other end of the first liquid-refrigerant pipe 311.

The waterproof tube 51 may cover the outer peripheral surface of the first curved section 312*a*-1 and the outer peripheral surface of the second curved section 312*a*-2 in the first example, or alternatively, may cover only the outer peripheral surface of the first curved section 312*a*-1 and need not cover the outer peripheral surface of the second curved section 312*a*-2.

The waterproof tube 51 may cover the outer peripheral surface of the upper end of the third liquid-refrigerant pipe 313 in the first example, or alternatively, need not cover the outer peripheral surface of the upper end of the third liquid-refrigerant pipe 313. In this case, the outer peripheral surface extending from the end of the second liquid-refrigerant pipe 312 adjacent to the first liquid-refrigerant pipe 311 to the end of the first curved section 312*a*-1 adjacent to the second curved section 312*a*-2 needs to be covered with the waterproof tube 51.

The waterproof tube 51 may be formed so as not to cover the outer peripheral surface of the lower end of the third liquid-refrigerant pipe 313 in the first example, or alternatively, may be formed so as to cover the outer peripheral surface of the lower end of the third liquid-refrigerant pipe 313. In other words, for example, the waterproof tube 51 may be formed so as to cover the entire outer peripheral surface of the third liquid-refrigerant pipe 313.

The outer peripheral surface of the first curved section 312*a*-1 of the first section 312*a* and the outer peripheral surface of the fifth section 312*e* may be covered with the waterproof tube 51 in the first example, or alternatively, the outer peripheral surface of the first curved section 312*a*-1 of the first section 312*a* and the outer peripheral surface of the fifth section 312*e* may be covered with a coating film. The coating film is made of a waterproof material (for example, fluororesin, fiber reinforced plastic (FRP), acrylic rubber, or the like). For example, the material may have heat resistance or elasticity.

For example, the coating film may be formed so as not to cover the outer peripheral surface of the second curved section 312*a*-2 of the first section 312*a*, or may be formed so as to cover the outer peripheral surface of the second curved section 312*a*-2 of the first section 312*a*.

Second Example

Figure 7:
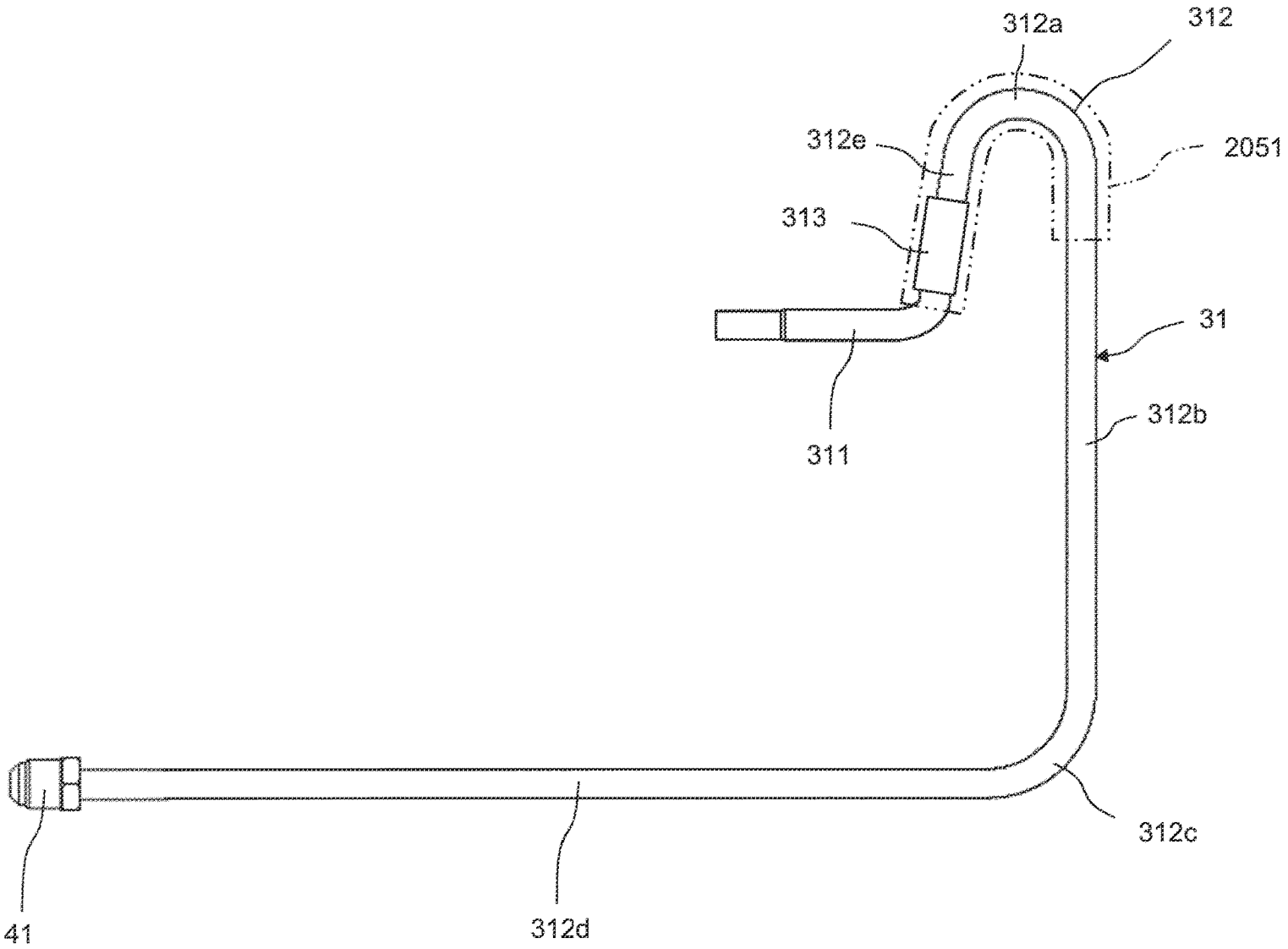
FIG. 7 is a front view of a liquid-refrigerant connection pipe of a second example of the present disclosure.

FIG. 7 is a front view of a liquid-refrigerant connection pipe 31 of an air conditioner of a second example of the present disclosure.

The air conditioner of the second example may be similar in configuration to the air conditioner of the first example except that a waterproof tube 2051 is provided. The waterproof tube 2051 is an example of the covering member.

The waterproof tube 2051 may be different from the waterproof tube 51 of the first example only in shape. More specifically, the waterproof tube 2051 may be formed longer than the waterproof tube 51 of the first example, and may also be in intimate contact with an outer peripheral surface of a right end of the first liquid-refrigerant pipe 311 to cover the entire circumference of the right end. The right end of the first liquid-refrigerant pipe 311 corresponds to an end of the first liquid-refrigerant pipe 311 adjacent to the second liquid-refrigerant pipe 312, i.e., a second-liquid-refrigerant-pipe 312-side end of the first liquid-refrigerant pipe 311.

In the air conditioner configured as described above, the waterproof tube 2051 further covers the outer peripheral surface of the right end of the first liquid-refrigerant pipe 311, so that it is possible to prevent liquid from adhering to the right end of the first liquid-refrigerant pipe 311. It is therefore possible to reduce the possibility that the first liquid-refrigerant pipe 311 suffers electrolytic corrosion.

The third liquid-refrigerant pipe 313 may be interposed between the first liquid-refrigerant pipe 311 and the second liquid-refrigerant pipe 312 in the second example, or alternatively, the third liquid-refrigerant pipe 313 need not be interposed. In other words, for example, the second liquid-refrigerant pipe 312 may be directly fluidly connected to the first liquid-refrigerant pipe 311. Also in this case, for example, the waterproof tube 2051 may cover the entire outer peripheral surface of the right end of the first liquid-refrigerant pipe 311.

Third Example

Figure 8:
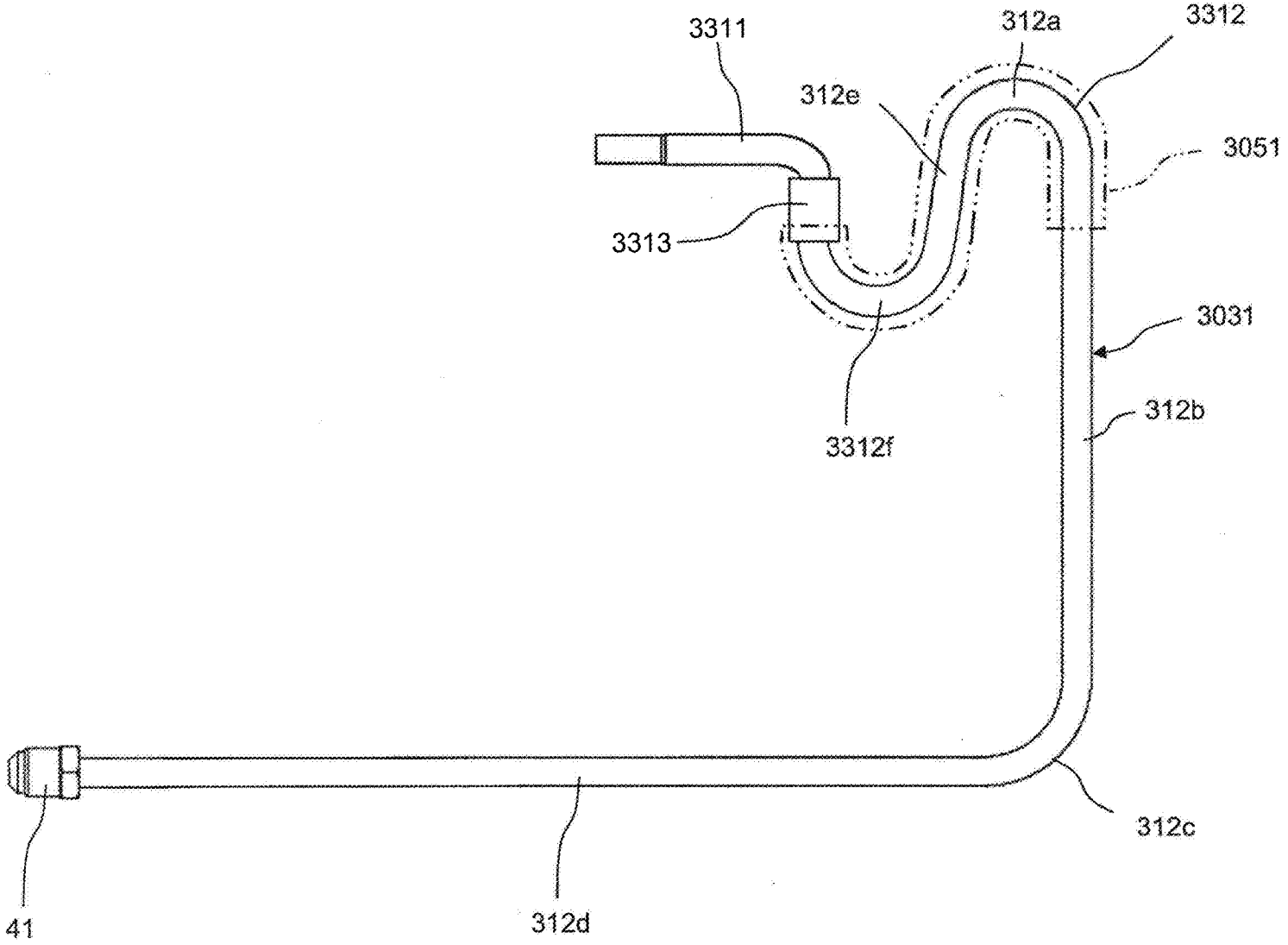
FIG. 8 is a front view of a liquid-refrigerant connection pipe of a third example of the present disclosure.

FIG. 8 is a front view of a liquid-refrigerant connection pipe 3031 of an air conditioner of a third example of the present disclosure.

The air conditioner of the third example may be similar in configuration to the air conditioner of the first example except that the liquid-refrigerant connection pipe 3031 and a waterproof tube 3051 are provided. The liquid-refrigerant connection pipe 3031 is an example of the connection pipe. The waterproof tube 3051 is an example of the covering member.

The liquid-refrigerant connection pipe 3031 includes a first liquid-refrigerant pipe 3311 formed of aluminum or an aluminum alloy, a second liquid-refrigerant pipe 3312 formed of copper or a copper alloy, and a third liquid-refrigerant pipe (a stainless steel refrigerant pipe) 3313 formed of stainless steel.

More specifically, the first liquid-refrigerant pipe 3311, the second liquid-refrigerant pipe 3312, and the third liquid-refrigerant pipe 3313 may be different from the first liquid-refrigerant pipe 311, the second liquid-refrigerant pipe 312, and the third liquid-refrigerant pipe 313 of the first example only in shape, respectively.

The first liquid-refrigerant pipe 3311 is disposed below the apex of the first section 312*a* of the second liquid-refrigerant pipe 3312 and above the third liquid-refrigerant pipe 3313.

The second liquid-refrigerant pipe 3312 may be identical in configuration to the second liquid-refrigerant pipe 312 of the first example, and may further include a bent section (a reverse bent section) 3312*f*.

The bent section 3312*f* is formed integrally with the other sections such as the first section 312*a* and the like, i.e., seamlessly with the other sections such as the first section 312*a* and the like. The bent section 3312*f* is bent to protrude downward. In other words, the bent section 3312*f* has a shape obtained by turning the first section 312*a* upside down. A right end of the bent section 3312*f* is continuous with the lower end of the fifth section 312*e*. On the other hand, a left end of the bent section 3312*f* is fixed to a lower end of the third liquid-refrigerant pipe 3313 by brazing. The right end of the bent section 3312*f* corresponds to an end of the bent section 3312*f* remote from the first liquid-refrigerant pipe 3311, i.e., an end of the bent section 3312*f*, the end being disposed on a side opposite to a first-liquid-refrigerant-pipe 3311-side. The left end of the bent section 3312*f* corresponds to an end of the bent section 3312*f* adjacent to the first liquid-refrigerant pipe 3311, i.e., a first-liquid-refrigerant-pipe 3311-side end of the bent section 3312*f*. The left end of the bent section 3312*f* further corresponds to an end of the second liquid-refrigerant pipe 3312 adjacent to the first liquid-refrigerant pipe 3311, i.e., a first-liquid-refrigerant-pipe 3311-side end of the second liquid-refrigerant pipe 3312. A lower end of the third liquid-refrigerant pipe 3313 corresponds to an end of the third liquid-refrigerant pipe 3313 adjacent to the second liquid-refrigerant pipe 3312, i.e., a second-liquid-refrigerant-pipe 3312-side end of the third liquid-refrigerant pipe 3313.

The third liquid-refrigerant pipe 3313 is disposed between the first liquid-refrigerant pipe 3311 and the second liquid-refrigerant pipe 3312. An upper end of the third liquid-refrigerant pipe 3313 is fixed to a right end of the first liquid-refrigerant pipe 3311 by brazing. The upper end of the third liquid-refrigerant pipe 3313 corresponds to an end of the third liquid-refrigerant pipe 3313 adjacent to the first liquid-refrigerant pipe 3311, i.e., a first-liquid-refrigerant-pipe 3311-side end of third liquid-refrigerant pipe 3313. The right end of the first liquid-refrigerant pipe 3311 corresponds to an end of the first liquid-refrigerant pipe 3311 adjacent to the second liquid-refrigerant pipe 3312, i.e., a second-liquid-refrigerant-pipe 3312-side end of the first liquid-refrigerant pipe 3311.

The waterproof tube 3051 may be different from the waterproof tube 51 of the first example only in shape. More specifically, the waterproof tube 3051 may be formed longer than the waterproof tube 51 of the first example, and may further cover the entire outer peripheral surface of the bent section 3312*f*.

In the air conditioner configured as described above, the second liquid-refrigerant pipe 3312 is provided with the bent section 3312*f* closer to the first liquid-refrigerant pipe 3311 than the first section 312*a*, the bent section 3312*f* being bent to protrude downward. This allows the bent section 3312*f* to stop, even when dew condensation water, for example, flows along the second liquid-refrigerant pipe 3312 from the first section 312*a* toward the first liquid-refrigerant pipe 311, the flow of dew condensation water. It is therefore possible to reduce the possibility that the first liquid-refrigerant pipe 3311 suffers electrolytic corrosion.

The third liquid-refrigerant pipe 3313 may be interposed between the first liquid-refrigerant pipe 3311 and the second liquid-refrigerant pipe 3312 in the third example, or alternatively, the third liquid-refrigerant pipe 3313 need not be interposed. In other words, for example, the second liquid-refrigerant pipe 3312 may be directly fluidly connected to the first liquid-refrigerant pipe 3311. In this case, for example, the outer peripheral surface extending from the left end of the bent section 3312*f* to the end of the first curved section 312*a*-1 adjacent to the second curved section 312*a*-2 (the second-curved-section 312*a*-2-side end of the first curved section 312*a*-1) may be covered with the waterproof tube 3051.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims. For example, the configurations of the second and third examples may be applied to the outdoor unit 2.

REFERENCE SIGNS LIST

1 indoor unit
2 outdoor unit
13 outdoor heat exchanger
15 indoor heat exchanger
31 liquid-refrigerant connection pipe
32 gas-refrigerant connection pipe
41 liquid-refrigerant flare union
42 gas-refrigerant flare union
51, 2051, 3051 waterproof tube
151 heat exchange portion
152 heat transfer tube
311, 3311 first liquid-refrigerant pipe
312, 3312 second liquid-refrigerant pipe
312*a* first section (bent section)
312*a*-1 first curved section
312*a*-2 second curved section
312*b* second section (vertical straight section)
312*c* third section (additional bent section)
312*d* fourth section (horizontal straight section)
312*e* fifth section (bent connecting section)
313, 3313 third liquid-refrigerant pipe (stainless steel refrigerant pipe)
321 first gas-refrigerant pipe
322 second gas-refrigerant pipe
P apex

What is claimed is:

1. A heat exchange unit comprising:
a heat exchanger; and
a connection pipe, connected to the heat exchanger, through which a refrigerant flows, wherein
the connection pipe includes:
a first refrigerant pipe that has one end connected to the heat exchanger and that is made of a first metal; and
a second refrigerant pipe that is made of a second metal higher in potential than the first metal of the first refrigerant pipe and that has one end connected to the other end of the first refrigerant pipe,
the second refrigerant pipe includes:
a first section that is bent to protrude upward and that has an end disposed on a side opposite to a first refrigerant pipe side; and
a second section that is continuous with the end of the first section and that extends along an approximate vertical direction,
the first section includes:
a first curved section disposed on the first refrigerant pipe side relative to an apex of the first section; and
a second curved section disposed on the side opposite to the first refrigerant pipe side relative to the apex of the first section, and
a covering member or a coating film is provided in intimate contact with the second refrigerant pipe and covers a first refrigerant pipe side edge of the second refrigerant pipe and the first curved section.

2. The heat exchange unit according to claim 1, wherein the covering member or the coating film covers a second refrigerant pipe side edge of the first refrigerant pipe.

3. The heat exchange unit according to claim 1, wherein the second refrigerant pipe has the one end connected to the other end of the first refrigerant pipe through a third refrigerant pipe, and the covering member or the coating film covers the third refrigerant pipe.

4. The heat exchange unit according to claim 1, wherein the covering member or the coating film covers the second curved section of the second refrigerant pipe.

5. The heat exchange unit according to claim 1, wherein the second refrigerant pipe includes a bent section that is bent to protrude downward.

6. The heat exchange unit according to claim 1, wherein the heat exchange unit is an indoor unit.

7. An air conditioner comprising the heat exchange unit according to claim 1.

* * * * *